United States Patent [19]

Yoshioka et al.

[11] Patent Number: 4,763,448

[45] Date of Patent: Aug. 16, 1988

[54] CENTERLESS GRINDING MACHINE

[76] Inventors: Junichi Yoshioka, 6-115 Makuhari-cho, Chiba-City, Chiba-pref.; Masakazu Miyashita, 1-13-5 Higashimotomachi, Kokubunji-City, Tokyo; Michimasa Daito, c/o Nissin Machine Works Limited, 300 Aritamanishimachi, Hamamatsu-city, Shizuoka-pref., all of Japan

[21] Appl. No.: 48,610

[22] Filed: May 11, 1987

[51] Int. Cl.[4] ..... B24B 5/18

[52] U.S. Cl. ..... 51/165.8; 51/165.9; 51/103 R

[58] Field of Search ..... 51/103 R, 105 R, 165.8, 51/165.9, 168

[56] References Cited

U.S. PATENT DOCUMENTS

| | | | |
|---|---|---|---|
| 2,834,159 | 5/1958 | Hill | 51/103 R |
| 3,593,463 | 7/1971 | Uhtenwoldt | 51/165.9 X |
| 3,634,976 | 1/1972 | Hahn et al. | 51/165.9 X |
| 3,732,648 | 5/1973 | Schaller | 51/103 R |
| 3,736,705 | 6/1973 | Ryan et al. | 51/168 |
| 4,370,835 | 2/1983 | von Schneidemesser et al. | 51/165.92 X |

FOREIGN PATENT DOCUMENTS

| | | | |
|---|---|---|---|
| 1391557 | 4/1975 | United Kingdom | 51/165.9 |

*Primary Examiner*—Robert P. Olszewski
*Attorney, Agent, or Firm*—Holman & Stern

[57] ABSTRACT

A centerless grinding machine comprising a grinding wheel on a rotational sleeve supported by a hydrostatic bearing means on a stationary spindle fixed to a grinding wheel table, a regulating wheel supported by a hydrostatic bearing on a spindle fixed to a regulating wheel table, and a blade for supporting a workpiece. Both wheel tables supporting the corresponding wheel are guided along a hydrodynamic sliding guide way to which a uniform pre-load is applied by hydrostatic bearings, and a servo mechanism is provided to compensate for frictional forces generated on the feed guide way, whereby it is possible to accomplish fine positioning of the corresponding wheel table and to grind the outer periphery of the workpiece with high precision and efficiency.

15 Claims, 5 Drawing Sheets

CENTERLESS GRINDING MACHINE

BACKGROUND OF THE INVENTION

1. Field of the Invention

The present invention relates to a centerless grinding machine for grinding workpieces mainly by using a super abrasive grinding wheel and with an ultra precision grinding operation.

2. Description of the Prior Art

Typically a centerless grinding machine is comprised of a grinding wheel, a regulating wheel, and a blade which is disposed between the two wheels for supporting a workpiece, whereby the workpiece supported by the blade and regulating wheel is ground to a desired dimension by the grinding operation of the grinding wheel facing the regulating wheel.

In such a centerless grinding machine, the grinding wheel is fixed to the rotational spindle through a tapered flange and the like, and is rotatively driven by a pulley mounted on one end of the rotational spindle. Further, when the grinding wheel becomes worn out, the position of a table provided for the grinding wheel is compensated by the amount of the wear for the accurate grinding to be effected. The guide ways for the grinding wheel table are formed by a hydrodynamic guide or low friction rolling guide way, or hydrostatic guide way. Such a machine which is manufactured for general purposes may also be applied to the grinding operation by the super abrasive grinding wheel.

In a grinding operation, the machining accuracies and efficiencies for a workpiece is mainly affected by the degree of accuracies and rigidities of the workpiece support and drive system and that of the grinding wheel including its rotational spindle.

When a large dimensioned super abrasive grinding wheel is to be used in a centerless grinding machine, and it is necessary to true the grinding wheel with accuracy, a special trueing machine provided apart from the grinding machine has to be used. In removing from the trueing machine the grinding wheel which has been trued and mounting it again on the grinding machine, any changes in accuracies should not occur that would increase the peripheral run-out of the wheel due to the mounting error of the wheel assembly in its transfer. However, in the structure of the conventional grinding machine, it is not possible to achieve the accuracy of the grinding wheel which satisfies the requirement to perform an ultra precision grinding operation, when the grinding wheel or grinding wheel unit which has been trued outside of, or apart from, the grinding machine is mounted again on the grinding machine.

Furthermore, in order to control the workpiece dimension to a high accuracy, it is necessary to accurately control the position of the grinding wheel tables. When a hydrodynamic guideway is used for the guideway for positioning the table, the accurate positioning of the wheel table can not be accomplished due to the influence of frictional force. In the structure which makes use of a low friction guideway, such as a rolling guideway and the like, there is such a defect that chatter vibrations tend to occur because of a low rigidity in the guiding direction, and this guideway is not appropriate for a high precision and efficient grinding.

SUMMARY OF THE INVENTION

Accordingly, a primary object of the present invention is to provide a centerless grinding machine which is capable of ensuring high rigidity and space saving construction of a grinding wheel unit and regulating wheel unit and of effecting the reliable reproducibility of the accuracies of the grinding wheel after it is dressed, by providing each of the units on a rotational sleeve supported by a hydrostatic bearing means on a spindle.

Another object of the present invention is to provide a centerless grinding machine which is capable of fine positioning of the corresponding wheel table and improvement in accuracies and efficiencies in grinding a workpiece, by providing a structure in which a pre-load is applied through a hydrostatic bearing onto a hydrodynamic sliding guide way which serves as a feed guide way of the grinding wheel table and regulating wheel table, and also by providing a servo mechanism which is operable to detect any frictional forces generated on the feed guide way and compensate for such frictional forces.

According to the present invention, there is provided a centerless grinding machine comprising a grinding wheel, a regulating wheel, tables each supporting a corresponding wheel, a blade for supporting a workpiece, a bed on which these elements are provided, a spindle fastened at the both ends to the associated table supporting the corresponding wheel, a rotational sleeve supported at the inner peripheral surface by hydrostatic radial bearing means, and thrust bearing means on the spindle and provided at the outer periphery with said grinding wheel and regulating wheel and at one end with a rotatively driving element, means to apply through a hydrostatic bearing a uniform pre-load to a hydrodynamic sliding guide way which serves as a feed guide way for guiding the corresponding table, and a servor mechanism which is operable to compensate for frictional forces generated on said feed guide way.

BRIEF DESCRIPTION OF THE DRAWINGS

The accompanying drawings show a preferred embodiment of a centerless grinding machine in accordance with the present invention, wherein.

DETAILED DESCRIPTION OF THE PREFERRED EMBODIMENT

Figure 1:
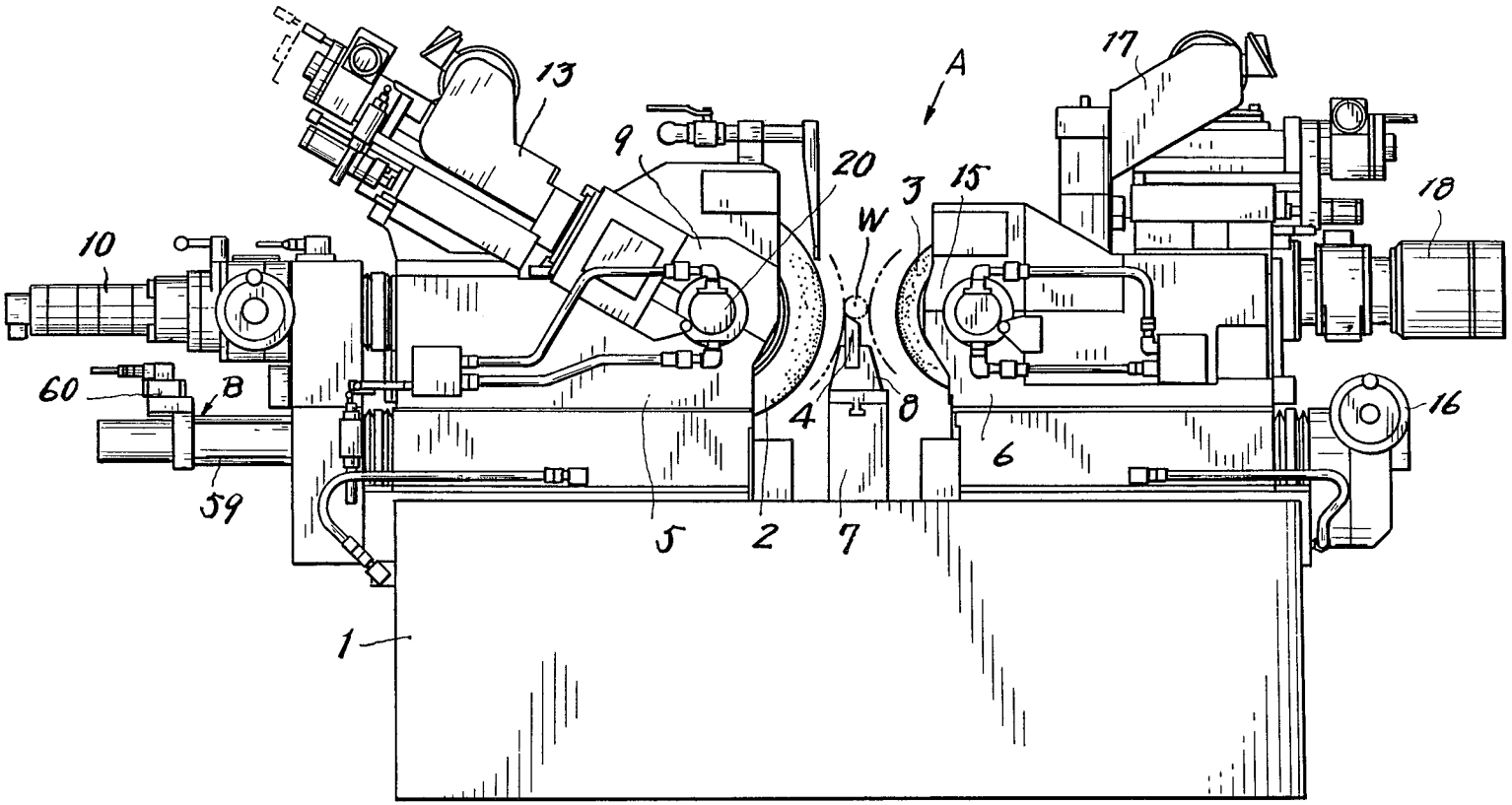
FIG. 1 is a front elevational view of the grinding machine.

An embodiment of a centerless grinding machine in accordance with the present invention will now be described in detail with reference to the accompanying drawings.

A centerless grinding machine A is mainly comprised of a bed 1, a grinding wheel 2, a regulating wheel 3, and a blade 4 for supporting a workpiece W. The workpiece W is supported in a V-shaped or wedged void space defined by the regulating wheel 3 and the surfaces of the blade 4. A grinding wheel table 5 for supporting the grinding wheel 2 is positioned by performing the table positioning movement, and the outer periphery of the supported workpiece W is ground by the grinding wheel 2 of a grinding wheel sleeve U (FIG. 2) supported by a hydrostatic radial bearing means and a thrust bearing means on a spindle 20 which is fixed on the grinding wheel table 5.

The blade 4 is provided on a workrest 8 mounted on a workrest mounting base 7, which is disposed between the grinding wheel table 5 and a regulating wheel table 6, and which is fixed to the bed 1.

The grinding wheel sleeve U is supported by the hydrostatic radial bearing means and thrust bearing means on the spindle 20. This spindle 20 is fixed to the grinding wheel table 5 by placing the spindle in semicircular supporting portions 5*a* and 5*b* provided on the upper surface of the grinding wheel table 5 so as to be received in these portions, covering the thus placed spindle with semicircular supporting portions 9*a* and 9*b* provided on the lower surface of a cover 9, and fastening the above elements by use of screw bolts. The grinding wheel table 5 is guided on the guideways provided below the table 5 and is operated by rotation of a driving motor 10 through a feed screw shaft 11, thus being able to move in the left or right direction as viewed in FIG. 1.

The grinding wheel 2 is rotatively driven by a driving motor (not shown), which is provided separately apart from the bed 1, through a belt 12 and intermediate shafts.

Reference number 13 designates a normal grinding wheel dressing trueing device for trueing the surface of a general purpose grinding wheel (not for super abrasive wheels), which is provided on the machine A on the side of the grinding wheel 2.

A stationary spindle for the regulating wheel 3 is mounted on the regulating wheel table 6 in the same manner as the spindle 20 for the grinding wheel, such that the stationary spindle is received in semi-circular supporting portions provided on the upper surface of the regulating wheel table 6, is covered with semi-circular supporting portions provided on the lower surface of a cover 15, and is fixed in place by screw bolts.

The regulating wheel table 6 is guided on the feed guide ways provided below the table 6 and is operated by a handle 16, or rotation of a feed motor, through a feed screw, thus being able to move in the left or right direction as viewed in FIG. 1. Reference number 17 designates a trueing device for trueing the surface of the regulating wheel 3, while reference number 18 designates a driving motor for the regulating wheel 3. The regulating wheel 3 is rotatively driven by this motor 18 through a reduction unit and intermediate shafts.

Figure 2:
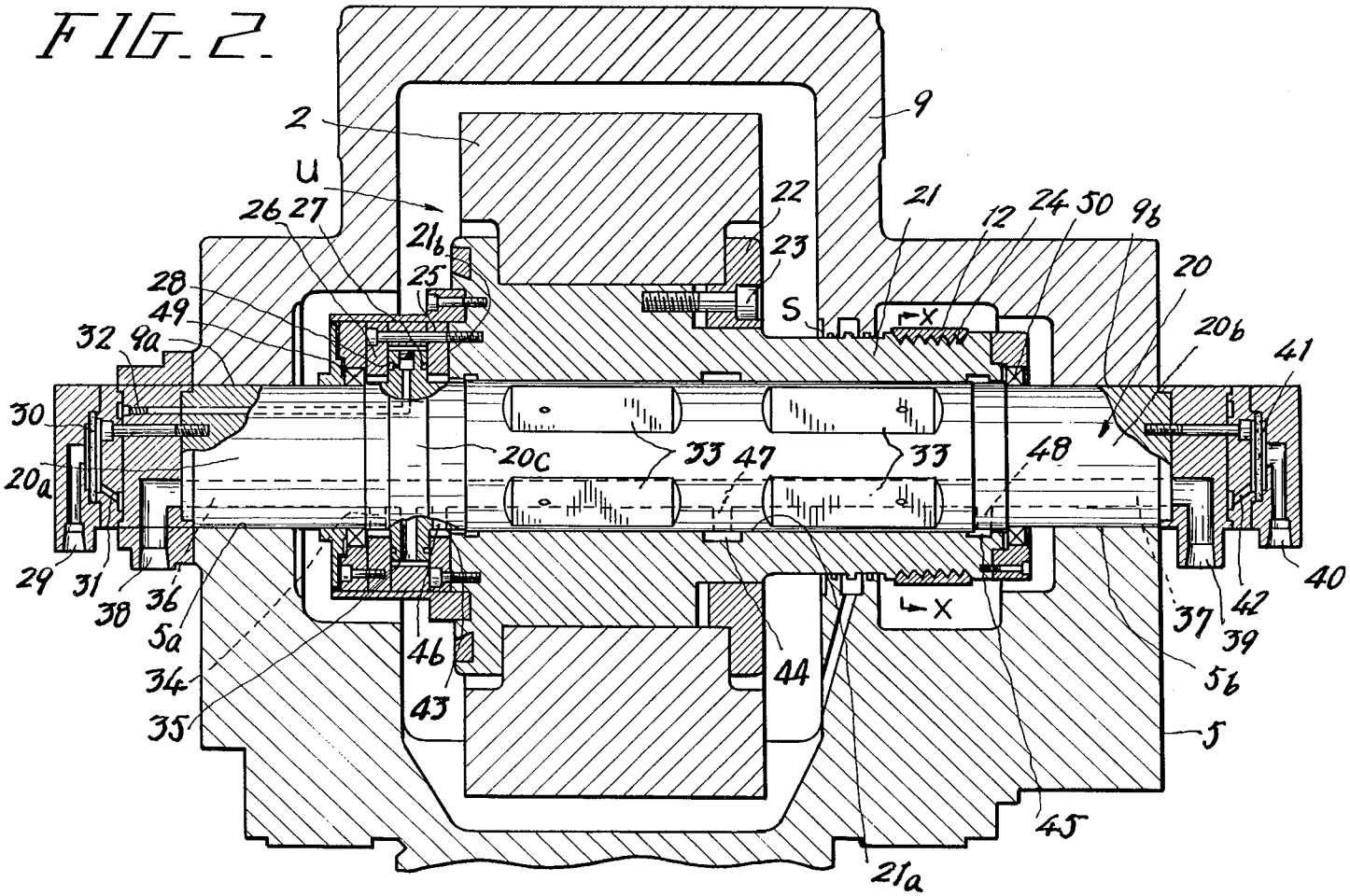
FIG. 2 is a longitudinal cross sectional view of a grinding wheel sleeve and grinding wheel table, viewed from the side of the grinding wheel.

FIG. 2 illustrates a grinding wheel sleeve and a grinding wheel, and assists in explaining the arrangement of these members. The spindle 20 is fixed to the grinding wheel table 5, as described above, by placing left and right ends 20*a* and 20*b* of the spindle 20 respectively in the semi-circular supporting portions 5*a* and 5*b* provided on the grinding wheel table 5, respectively covering the upper portions of the both ends of the spindle 20 with the semi-circular supporting portions 9*a* and 9*b* of the cover 9, and fastening them by screw bolts. This spindle 20 supports the grinding wheel sleeve U by the hydrostatic radial bearing means and thrust bearing means provided on the spindle 20 which is stationary, and the grinding wheel sleeve U is arranged on the spindle 20 within the grinding wheel table 5. The grinding wheel sleeve U comprises a rotational sleeve 21, and the grinding wheel 2 which is fitted on the outer periphery of the rotational sleeve 21 and fixed thereto by fastening a screw bolt 23 in the axial direction through a movable flange 22. The rotational sleeve 21 is provided at one end thereof with a rotatively driving pulley portion 24 on which the belt 12 is disposed. The inner peripheral surface 21*a* of the rotational sleeve 21 serves as a rotational hydrostatic radial bearing surface, while the left end surface 21*b* of the rotational sleeve 21 serves as the reference surface for mounting thrust bearing plates 25 and 26. With this arrangement, the rotational sleeve 21 is rotatively driven by the belt 12 while the spindle 20 is kept stationary. The rotatively driving pulley portion 24 is provided with a labyrinth seal portion S for preventing penetration of any grinding fluid. The spingle 20 has near its left end a projecting thrust flange 20*c* which constitutes the thrust bearing means. The thrust flange 20*c* is provided on either of the sides thereof with an annular thrust pocket 27 or 28.

Pressurized oil is supplied to these thrust pockets 27 and 28 in the following manner. Pressurized oil is supplied from a supply port 29 to the thrust pocket 29 through an accommodated filter 30, distribution pipe line 31, and restrictor 32. The thrust pocket 27 as well as radial arranged pockets 33 of the spindle 20 is supplied with pressurized oil in the same manner. Oil flowing out of the bearing means is discharged from drain ports 38 and 39 to the outside of the machine through drain pipe lines 34, 35, 36 and 37.

Figure 3:
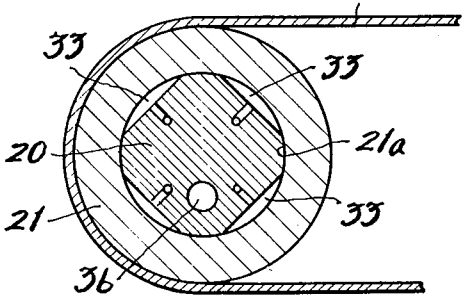
FIG. 3 is a cross sectional view taken along the line X—X shown in FIG. 2.

Referring to FIG. 3, the stationary spindle 20 is provided on the outer periphery with radial pockets 33 which comprise two pairs of pockets arranged axially. Each radial pocket 33 is supplied with pressurized oil from supply ports 29 and 40 through filters 30 and 41, pipe lines 31 and 42 and an orifice. Oil flowing out from the bearing surface clearance between the outer periphery of the spindle 20 and the inner periphery 21*a* of the rotational sleeve 21 is allowed to flow into internal annular gaps 43, 44 and 45 and discharged from the discharge ports 38 and 39 through oil discharge pipe lines 46, 47, 48, 36 and 37. Oil seals 49 and 50 are disposed such as to seal the annular gaps for discharge of oil, thus preventing any oil from escaping outside.

Thus, the hydrostatic radial bearing means is formed between the outer periphery of the stationary spindle 20 and the inner periphery of the rotational sleeve 21 of the grinding wheel sleeve U, thereby supporting the rotational sleeve 21 on the stationary spindle 20 in a non-contact manner and thus determining the position of the former.

Figure 4:
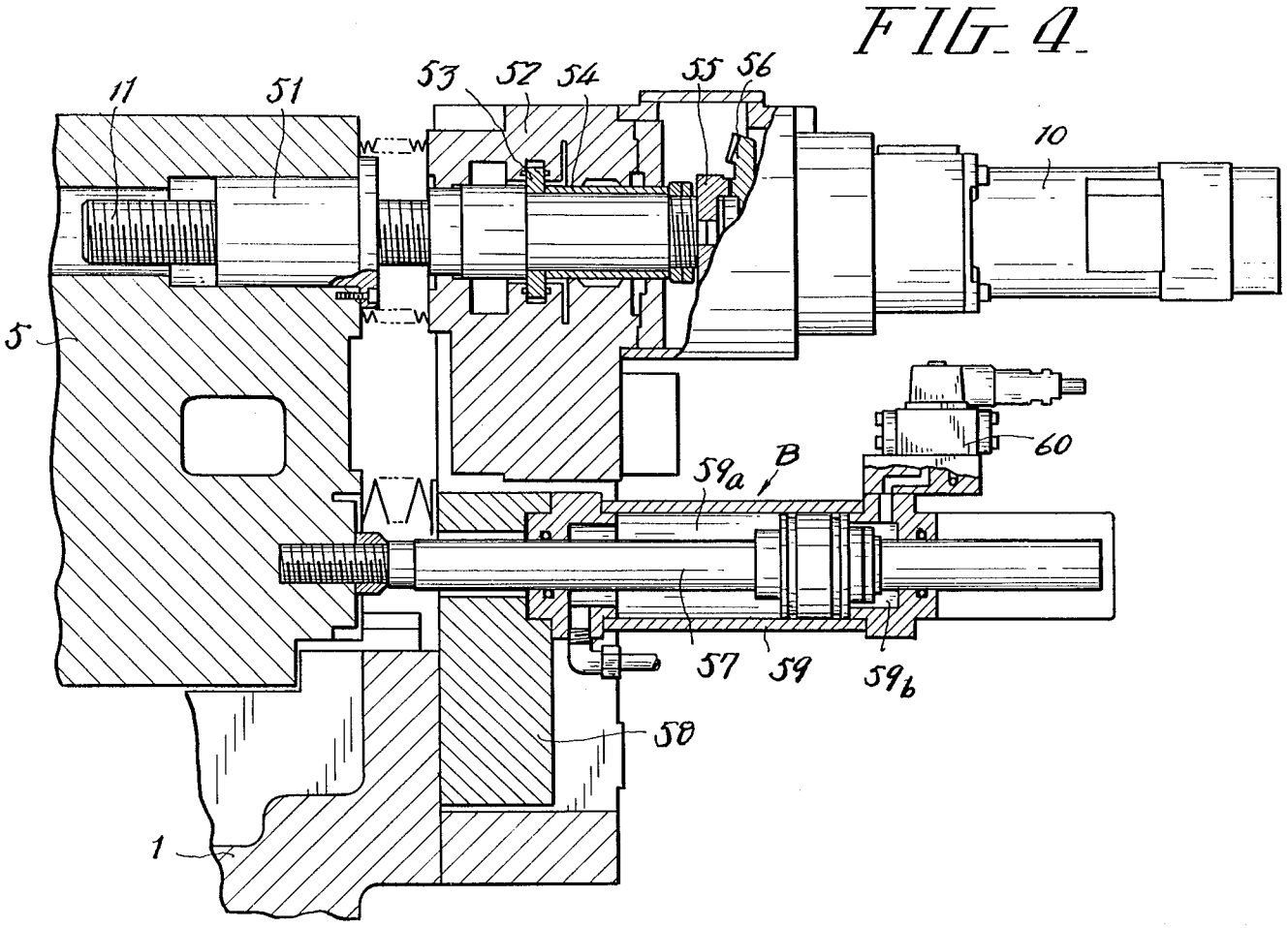
FIG. 4 is a fragmentary longitudinal cross sectional view of a table positioning portion of the grinding wheel table.

The structure for causing the table positioning movement of the grinding wheel table 5 will be described with reference to FIG. 4. A feed screw nut 51 an one end of a feed screw shaft 11, which is screwed into the feed screw nut 51, are mounted on the rear side surface of the grinding wheel table 5 at a height corresponding to that of the center of the grinding wheel 2. The nut 51 is composed of a double nut onto which a certain preload is applied so that there will be residual clearance. The other end of the feed screw shaft 11 is supported in a non-contact manner by a hydrostatic thrust bearing 53 and a hydrostatic radial bearing 54 which are provided within a bracket 52 mounted on the bed 1. An internal gear coupling plate 55 is mounted on the end face of the feeding screw shaft 11, and this plate 55 is engaged with an external gear plate 56 provided on the driving side of the machine. The external gear plate 56 is connected to the driving motor 10 through a reduction unit, while the internal gear coupling plate 55 is arranged to be movable in the axial direction without transmitting any thrust load.

Accordingly, the feed screw shaft 11 is rotated by the driving motor 10 through other associated elements, whereby the grinding wheel table 5 can be moved in the left or right direction. At this time, frictional force is generated on the feed guide ways provided below the grinding wheel table 5, while a thrust force corresponding to this frictional force is applied to various components of the feed system.

When a large frictional force is generated, the screw mounting bracket 52 becomes elastically deformed in the left or right direction and this causes a reduction in the positioning accuracy. This phenomenon also leads to incorrect positioning when the feeding direction is inverted.

In the event that the screw mounting bracket 52 is deformed, it is impossible to move the grinding wheel table 5 by an amount corresponding to the rotational angle of the screw shaft.

In order to avoid such problems, a hydraulic actuator B is provided in accordance with the present invention below the grinding wheel table 5 at a location corresponding to the position of the feed guide ways. In this hydraulic actuator B, a piston rod 57 is fixed at one end to the grinding wheel table 5 and is slidably inserted into a cylinder 59 which is fixed to an actuator mounting bracket 58, and this bracket 58 is, in turn, fixed to the bed 1. A servo valve 60 is also provided on the hydraulic actuator B so as to supply selectively the output pressure oil to a pressure chamber 59*a* or 59*b*.

Figure 5:
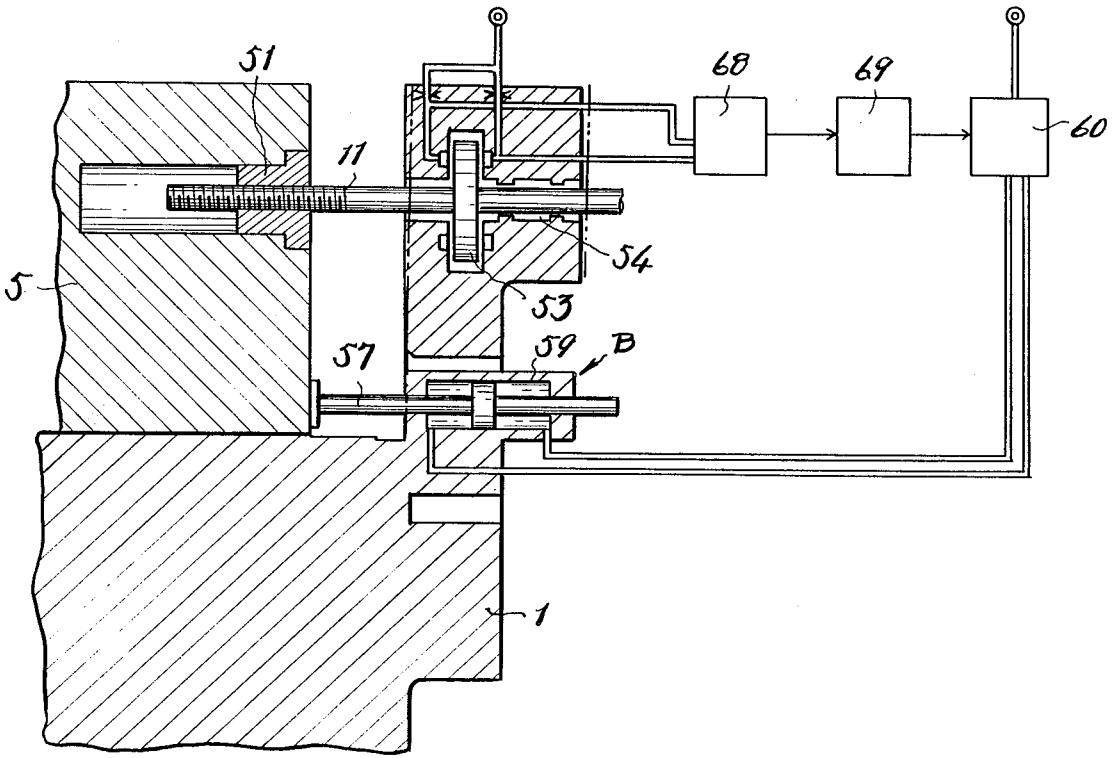
FIG. 5 is an explanatory schematic and partly cross-sectional view of a device for detecting a force applied to a feed screw shaft.

The design according to the present invention is, therefore, such that the force applied to the feed screw shaft 11 is detected, the hydraulic actuator B is made to generate the force required for moving the grinding wheel table 5, and the servo valve 60 is made to operate so as to constantly minimize the force applied to the screw shaft 11, thus eliminating deformation of the screw mounting bracket 52, and thereby enabling movement of the grinding wheel table 5 by an amount corresponding to the rotational angle of the screw shaft. Such operation concerning the force applied to the feeding screw shaft 11 will be explained with reference to FIG. 5.

The pressure difference between the opposite pockets of the hydrostatic thrust bearing 53 is proportional to the force applied to the feeding screw shaft 11. Therefore, this pressure difference is electrically detected by a pressure difference sensor 68, and a correction signal is supplied to the servo valve 60 through servo amplifier 69.

Figure 6:
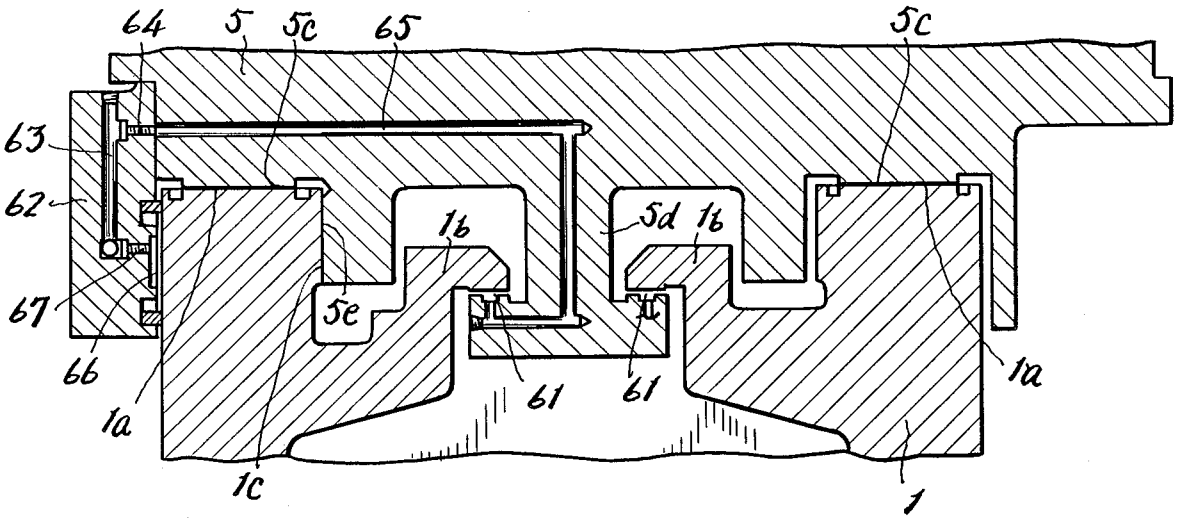
FIG. 6 is a longitudinal cross-sectional view showing the arrangement of a guideway of the grinding wheel table and a bed.

FIG. 6 shows the arrangement of a wheel table and the guide ways on the bed 1. Guide ways 1*a* which extend in the horizontal direction are provided on the upper surface of the bed 1, while the lower surface of the grinding wheel table 5 has guide ways 5*c* which cooperate with guide ways 1*a* to form a hydrodynamic sliding guide way. The grinding wheel table 5 has on a central lower portion thereof a T-shaped protrusion 5*d*. Left and right horizontal portions of this protrusion 5*d* are brought into facing relationship with a pair of protrusions 1*b* provided on the central portion of the bed 1.

Hydrostatic pockets 61 are provided on the horizontal portion of the protrusion 5*d* at locations facing the corresponding protrusions 1*b* of the bed 1. These pockets 61 are supplied with pressurized oil from a supply port 63 formed in a terminal 62, which is mounted on the grinding wheel table 5, through a restrictor 64 and a pipe line 65. Pressure within the pockets 61 thus acts to urge the grinding wheel table 5 in the downward direction, and thus serves to apply an additional preload to the hydrodynamic sliding guide ways 5*c*.

The terminal 62 has hydrostatic pockets 66 to which pressurized oil is supplied through an orifice 67. These pockets 66 and the mating lateral surface of the bed 1 form a hydrostatic bearing. That is, the reaction force of the pressure within the pockets 66 acts on grinding wheel table 5 to urge vertical guide way 5*e* thereon toward a vertical guide way 1*c* on the bed 1, and thus serves to apply a pre-load to the hydrodynamic sliding guide ways formed by the vertical guide ways 5*e* and 1*c*.

With this arrangement, the pre-load can be adjusted with ease by varying the supply pressure of oil supplied from the supply port 63.

A plurality of such pockets for applying pre-load are provided in the direction in which the table 5 is guided, so that the pre-load can be uniformly applied.

Therefore, in the above-mentioned constitution of the present invention, a highly rigid and space saving construction of a grinding wheel and a regulating wheel is obtained and it is possible to prevent the mounting error from being caused due to transfer of the wheels for trueing outside of the machine. Further, the fine positioning of the wheel table can be accurately effected. Furthermore, the precision and efficiency in working of the workpiece can be increased. In addition, the construction is simple.

We claim:

1. A centerless grinding machine comprising:

a machine bed;

a workpiece supporting blade mounted on said bed;

a grinding wheel table and regulating wheel table each slidably mounted on said bed on opposite sides of said supporting blade;

a grinding wheel spindle and regulating wheel spindle each having opposite ends fixedly mounted on said grinding wheel table and regulating wheel table, respectively, at said ends;

a grinding wheel support sleeve and regulating wheel support sleeve each rotatably mounted on a respective one of said spindles, each wheel support sleeve having opposite ends;

a grinding wheel and a regulating wheel each mounted on a respective one of said wheel support sleeves;

hydrostatic radial bearing means between each spindle and a respective one of said wheel support sleeves;

hydrostatic thrust bearing means between each spindle and a respective one of said wheel support sleeves;

driving means operatively engageable with one end of each of said wheel support sleeves for driving said wheel support sleeves rotatably;

guideway hydrostatic bearing means between each wheel table and said bed providing hydrodynamic sliding guideway means for slidably supporting said wheel table on said bed;

a means for applying a uniform pre-loading to at least one of said sliding guideway means through the respective guideway hydrostatic bearing means; and a feed mechanism for positioning said grinding wheel table comprising, a feed screw shaft rotatably mounted on said bed and operatively engaging said grinding wheel table so that rotation of said feed screw shaft moves said wheel table along the grinding wheel sliding guideway means relative to said bed, means for rotating said feed screw shaft, a hydrostatic thrust bearing on said feed screw shaft having axially opposite sides, pressure sensing means for sensing pressure on said axially opposite sides produced by frictional forces generated at said grinding wheel sliding guideway means, a compensating fluid cylinder and piston means operatively engaging between said bed and said grinding wheel table for moving said grinding wheel table by fluid pressure applied to said cylinder, and servo means operatively connected to said pressure sensing means and to said cylinder for operating said cylinder in response to said pressure sensing means for compensating for said frictional forces.

2. A centerless grinding machine as claimed in claim 1 wherein said hydrostatic thrust bearing on said feed screw shaft comprises:

a bracket mounted on said bed;

a cavity in said bracket;

a flange on said feed screw shaft, said feed screw spindle being rotatably mounted in and extending through said bracket with said flange disposed in said cavity;

said axially opposite sides of said feed screw hydrostatic bearing being axially opposite sides of said flange;

fluid pressure means in said cavity acting on said axially opposite sides of said flange; and said pressure sensing means senses pressure differential on said opposite sides of said flange.

3. A centerless grinding machine as claimed in claim 2 wherein said compensating fluid cylinder and piston means comprises:

a cylinder bracket on said bed;

a double-acting fluid cylinder in said bracket;

a double-acting piston in said cylinder;

piston rod means connected to said piston and having one outer end connected to said grinding wheel table;

said servo means being a servo having an inlet connected to a fluid pressure source; and fluid pressure lines each having one end connected to said cylinder on opposite sides of said piston and on the other end connected to said servo valve so that said servo valve controls fluid pressure fed to the inlet thereof selectively to said fluid pressure lines.

4. A centerless grinding machine as claimed in claim 1 wherein said compensating fluid cylinder and piston means comprises:

a cylinder bracket on said bed;

a double-acting fluid cylinder in said bracket;

a double-acting piston in said cylinder;

piston rod means connected to said piston and having one outer end connected to said grinding wheel table;

said servo means being a servo having an inlet connected to a fluid pressure source; and fluid pressure lines each having one end connected to said cylinder on opposite sides of said piston and the other end connected to said servo valve so that said servo valve controls fluid pressure fed to the inlet thereof selectively to said fluid pressure lines.

5. A centerless grinding machine as claimed in claim 1 wherein:

said at least one hydrodynamic sliding guideway means comprises cooperating substantially horizontal guideway surfaces and cooperating substantially vertical surfaces on said bed and said grinding wheel table; and said means for applying uniform pre-loading comprises fluid pressure means for applying fluid pressure to said cooperating surfaces.

6. A centerless grinding machine comprising:

a machine bed;

a workpiece supporting blade mounted on said bed;

a grinding wheel table and regulating wheel table each slidably mounted on said bed on opposite sides of said supporting blade;

a stationary grinding wheel spindle and regulating wheel spindle each having opposite ends fixedly mounted on said grinding wheel table and regulating wheel table, respectively, at said ends;

a grinding wheel support sleeve and regulating wheel support sleeve each rotatably mounted on a respective one of said spindles, each rotatably mounted on a respective one of said spindles, each wheel support sleeve having opposite ends;

a grinding wheel and a regulating wheel each mounted on a respective one of said wheel support sleeves;

driving means operatively engageable with one end of each of said wheel support sleeves for driving said wheel support sleeves rotatably;

guideway hydrostatic bearing means between said grinding wheel table and said bed providing hydrodynamic sliding guideways for slidably supporting said grinding wheel table on said bed;

a means for applying a uniform pre-loading to said sliding guideways; and a feed mechanism for positioning said grinding wheel table comprising, a feed drive member mounted on said bed and operatively engaging said grinding wheel table so that operation of said feed drive member moves said grinding wheel table along the grinding wheel sliding guideways relative to said bed, means for operating said feed drive member, a hydrostatic thrust bearing on said feed drive member having opposite sides, pressure sensing means for sensing pressure on said opposite sides produced by frictional forces generated at said grinding wheel sliding guideways.

a compensating fluid cylinder and piston means operatively engaging between said bed and said grinding wheel table for moving said grinding wheel table by fluid pressure applied to said cylinder, and servo means operatively connected to said pressure sensing means and to said cylinder for operating said cylinder in response to said pressure sensing means for compensating for said frictional forces.

7. A centerless grinding machine as claimed in claim 6 wherein:

said feed drive member comprises a shaft rotatably mounted on said bed and threadedly engaging said grinding wheel table so that rotation of said shaft moves said grinding table; and said feed drive operating means comprises means for rotating said shaft.

8. A centerless grinding machine as claimed in claim 6 wherein said hydrostatic thrust bearing on said feed drive member comprises:

a cavity means on said bed;

a flange on said feed drive member having said opposite sides and disposed in said cavity; and fluid pressure means in said cavity acting on said opposite sides of said flange.

9. A centerless grinding machine as claimed in claim 8 wherein:

said pressure sensing means senses differential pressure on said opposite sides of said flange.

10. A centerless grinding machine as claimed in claim 8 wherein:

said feed drive member comprises a shaft rotatably mounted on said bed and threadedly engaging said grinding wheel table so that rotation of said shaft moves said grinding table; and said feed drive operating means comprises means for rotating said shaft.

11. A centerless grinding machine as claimed in claim 10 wherein:

said pressure sensing means senses differential pressure on said opposite sides of said flange.

12. A centerless grinding machine as claimed in claim 6 wherein said compensating fluid cylinder and piston means comprises:

a cylinder bracket on said bed;

a double-acting fluid cylinder in said bracket;

a double-acting piston in said cylinder;

piston rod means connected to said piston and having one outer end connected to said grinding wheel table;

said servo means being a servo having an inlet connected to a fluid pressure source; and fluid pressure lines each having one end connected to said cylinder on opposite sides of said piston and the other end connected to said servo valve so that said servo valve controls fluid pressure fed to the inlet thereof selectively to said fluid pressure lines.

13. A centerless grinding machine as claimed in claim 11 wherein said compensating fluid cylinder and piston means comprises:

a cylinder bracket on said bed;

a double-acting fluid cylinder in said bracket;

a double-acting piston in said cylinder;

piston rod means connected to said piston and having one outer end connected to said grinding wheel table;

said servo means being a servo having an inlet connected to a fluid pressure source; and fluid pressure lines each having one end connected to said cylinder on opposite sides of said piston and the other end connected to said servo valve so that said servo valve controls fluid pressure fed to the inlet thereof selectively to said fluid pressure lines.

14. A centerless grinding machine as claimed in claim 6 wherein:

said hydrodynamic sliding guideways comprise cooperating substantially horizontl surfaces and cooperating substantially vertical surfaces on said grinding wheel table; and said means for applying a uniform pre-loading comprises fluid pressure means for applying fluid pressure to said cooperating surface.

15. A centerless grinding machine as claimed in claim 13 wherein:

said hydrodynamic sliding guideways comprise cooperating substantially horizontal surfaces and cooperating substantially vertical surfaces on said grinding wheel table; and said means for applying a uniform pre-loading comprises fluid pressure means for applying fluid pressure to said cooperating surface.

* * * * *